US012305964B2

(12) United States Patent
Finsterbusch

(10) Patent No.: US 12,305,964 B2
(45) Date of Patent: May 20, 2025

(54) ALTERNATE ARMOR PIERCING BULLET CONFIGURATION

(71) Applicant: Gregory Victor Finsterbusch, Pataskala, OH (US)

(72) Inventor: Gregory Victor Finsterbusch, Pataskala, OH (US)

( * ) Notice: Subject to any disclaimer, the term of this patent is extended or adjusted under 35 U.S.C. 154(b) by 38 days.

(21) Appl. No.: 18/348,153

(22) Filed: Jul. 6, 2023

(65) Prior Publication Data

US 2024/0318944 A1 Sep. 26, 2024

Related U.S. Application Data

(60) Provisional application No. 63/367,858, filed on Jul. 7, 2022.

(51) Int. Cl.

| | |
|---|---|
| ***F42B 12/06*** | (2006.01) |
| ***F42B 12/08*** | (2006.01) |
| ***F42B 12/74*** | (2006.01) |
| ***F42B 33/00*** | (2006.01) |

(52) U.S. Cl.

CPC ..... *F42B 12/06* (2013.01); *F42B 12/08* (2013.01); *F42B 12/74* (2013.01); *F42B 33/001* (2013.01)

(58) Field of Classification Search

CPC ..... F42B 12/04; F42B 12/06; F42B 12/08; F42B 12/74; F42B 33/00; F42B 33/001

USPC ..... 102/514, 518, 519

See application file for complete search history.

(56) References Cited

U.S. PATENT DOCUMENTS

| | | | | |
|---|---|---|---|---|
| 932,014 | A * | 8/1909 | Haase | F42B 12/06 102/519 |
| 4,256,039 | A * | 3/1981 | Gilman | F42B 12/06 102/517 |
| 5,794,320 | A * | 8/1998 | Wernz | F42B 12/78 102/517 |
| 6,305,293 | B1 | 10/2001 | Fry et al. | |
| 8,074,574 | B2 * | 12/2011 | Riess | F42B 12/06 102/518 |
| 10,551,154 | B2 | 2/2020 | Peterson | |
| 10,890,423 | B2 * | 1/2021 | Stadelmann | F42B 12/06 |
| 2008/0092767 | A1 | 4/2008 | Taylor | |

(Continued)

FOREIGN PATENT DOCUMENTS

WO WO-2017171692 A2 * 10/2017 ..... F42B 12/06

OTHER PUBLICATIONS

Nammo, 5.56 mm x 45 Armor Piercing 3 (M995), Retrieved from Internet, Retrieved on Jul. 6, 2023, <URL: https://www.nammo.com/product/our-products/ammunition/small-caliber-ammunition/5-56mm-series/5-56-mm-x-45-armor-piercing-3/>.

*Primary Examiner* — James S Bergin

(57) ABSTRACT

The alternate armor-piercing bullet is a firearm projectile that is designed to provide high accuracy and improved armor penetration. To accomplish this, the firearm projectile comprises a penetrator, a jacket, and a temperature-resistant metallic paste. The penetrator has an exterior tip with a full-length shaft positioned inside of the jacket. The outer surfaces of the shaft and the inner surfaces of the jacket are coated with the metallic paste. When the projectile is fired from a gun, the metallic paste holds the jacket and the penetrator together until impacting the armor. Once the armor is pierced, the penetrator's full-length shaft assists in directional stability, allowing the penetrator to maintain its trajectory and reach the intended target.

10 Claims, 6 Drawing Sheets

(56) References Cited

U.S. PATENT DOCUMENTS

| | | | |
|---|---|---|---|
| 2011/0252997 | A1 | 10/2011 | Hoffman |
| 2018/0135950 | A1 | 5/2018 | Agazim |

* cited by examiner

ALTERNATE ARMOR PIERCING BULLET CONFIGURATION

FIELD OF THE INVENTION

The present invention relates generally to the field of firearm projectiles. More specifically, the present invention is an armor-piercing bullet that comprises a penetrator having an exterior tip and a full-length shaft that fits into a jacket. The present invention also comprises a method for joining the penetrator to the jacket.

BACKGROUND OF THE INVENTION

Generally, there are two types of AP bullets known in the industry. The first type is composed of three parts: an exterior penetrator tip, jacket, and core. The penetrator tip is usually made of hardened steel and is designed to exert a high amount of energy into the target. Directly behind the penetrator tip is the bullet core, designed to impact the target after the penetrator pierces the armor. A bullet jacket encloses the core and penetrator. The jacket is typically made of copper alloy to avoid damaging the barrel of the rifle. Upon impact, the jacket temporarily softens the front of the armor, thereby cushioning the impact for the penetrator and preventing the tip from breaking apart. The jacket then separates from the bullet at the point of impact, allowing the core and penetrator to penetrate through the armor.

The problem with this type of AP bullet is that after penetrating the armor, the remaining projectile tends to spall or fragment. Although the fragmentation has the potential of hitting the intended target, this level of inaccuracy can also result in missing the target altogether. This is an inherent design flaw based on the internal components and their arrangement within the AP bullet. More specifically, the steel penetrator's tip is designed only for piercing the armor. Once the armor is pierced and the jacket separates, the tip and core tend to lose directional stability and disperse in different directions.

A second type of AP bullet is typically composed of an internal steel penetrator pressed into the rear cavity of a copper jacket. The jacket has an exterior tip and fully encloses the penetrator. A machined cap is then inserted into the rear cavity of the jacket to seal the internal penetrator. Although this type of bullet performs similar to the first type described above, it differs in that the jacket tip is designed to penetrate the armor to some degree and acts to shield the inner penetrator for a short time. This short time gives the penetrator a running start to try and continue to pierce the armor after the jacket separates.

This type of AP bullet (internal penetrator) shares a similar flaw with the first type (external penetrator tip). Although the internal penetrator also acts as the core, it is still shorter in length than the jacket, which can affect the penetrator's directional stability after piercing the armor. In addition, the process of manufacturing each AP bullet can be time consuming, considering the jacket cavity and rear cap have to be precision machined with low tolerances in order to press fit the penetrator into the jacket.

An objective of the present invention is to provide a solution to the aforementioned problems. This invention utilizes a penetrator with an exterior tip and a cylindrical shaft that runs the entire length of the jacket. This invention also includes a unique method of joining the penetrator to the jacket using a temperature-resistant metallic repair paste, which is less time consuming than other known methods in the industry. When the bullet is fired, the metallic paste holds the jacket and penetrator together until impacting the armor. Once the armor is pierced, the penetrator's long shaft assists in directional stability, allowing the penetrator to maintain its trajectory and reach the intended target.

SUMMARY

It is an aim of the present invention to provide an armor-piercing (AP) bullet that has improved accuracy and improved armor penetration over other AP bullets on the market today. In addition, the present invention also includes a unique method for fabricating an AP bullet that is less time consuming and more cost effective than the standard methods used today. The present invention is an alternate AP bullet that comprises a penetrator, a jacket, and a temperature-resistant metallic paste. A key distinction between the present invention and other AP bullets is (1) the tip of the penetrator is exposed, (2) the shaft of the penetrator extends nearly the entire length of the jacket, and (3) the penetrator and the jacket are bonded together using the metallic paste.

The method for fabricating the alternate AP bullet involves a series of steps. First, the user coats the penetrator with metallic paste, covering all sides. Second, the user fully inserts the penetrator into the bore hole of the jacket until the tip base of the penetrator sits flush with the top surface of the jacket. Third, the user rotates the penetrator with respect to the jacket. This helps distribute the metallic paste evenly along the interior sidewall of the jacket. Lastly, the user applies another coating of metallic paste in a rear cavity formed at the bottom surface of the jacket. Once cured, the metallic paste provides a strong adhesive bond between the penetrator and the jacket.

When the alternate AP bullet is fired from a gun, the metallic paste holds the jacket and the penetrator together until impacting the armor. Once the armor is pierced, the penetrator's long shaft assists in directional stability, allowing the penetrator to maintain its trajectory and reach the intended target.

DETAIL DESCRIPTIONS OF THE INVENTION

All illustrations of the drawings are for the purpose of describing selected versions of the present invention and are not intended to limit the scope of the present invention.

In reference to FIG. 1 through FIG. 10, the present invention is an alternate armor-piercing (AP) bullet 1. A key distinction between the present invention and other AP bullets is (1) the tip of the penetrator is exposed, (2) the shaft of the penetrator extends nearly the entire length of the jacket, and (3) the penetrator and the jacket are bonded together using a temperature-resistant metallic paste. As will be explained in further detail below, these distinct features enable the present invention to have higher accuracy and improved armor penetration over other AP bullets.

Figure 1:
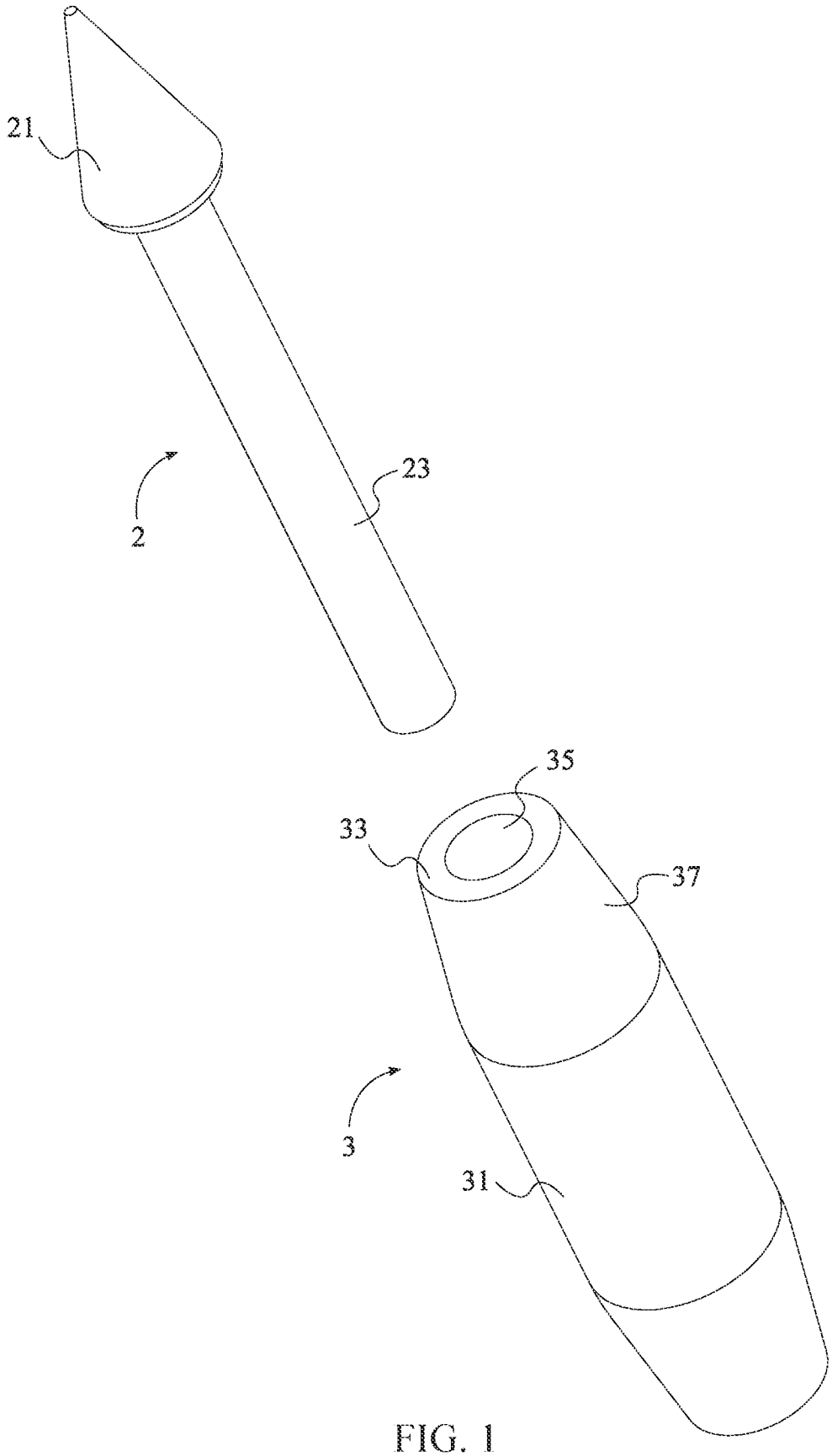
FIG. 1 is a top-front perspective exploded view of the present invention.
Figure 2:
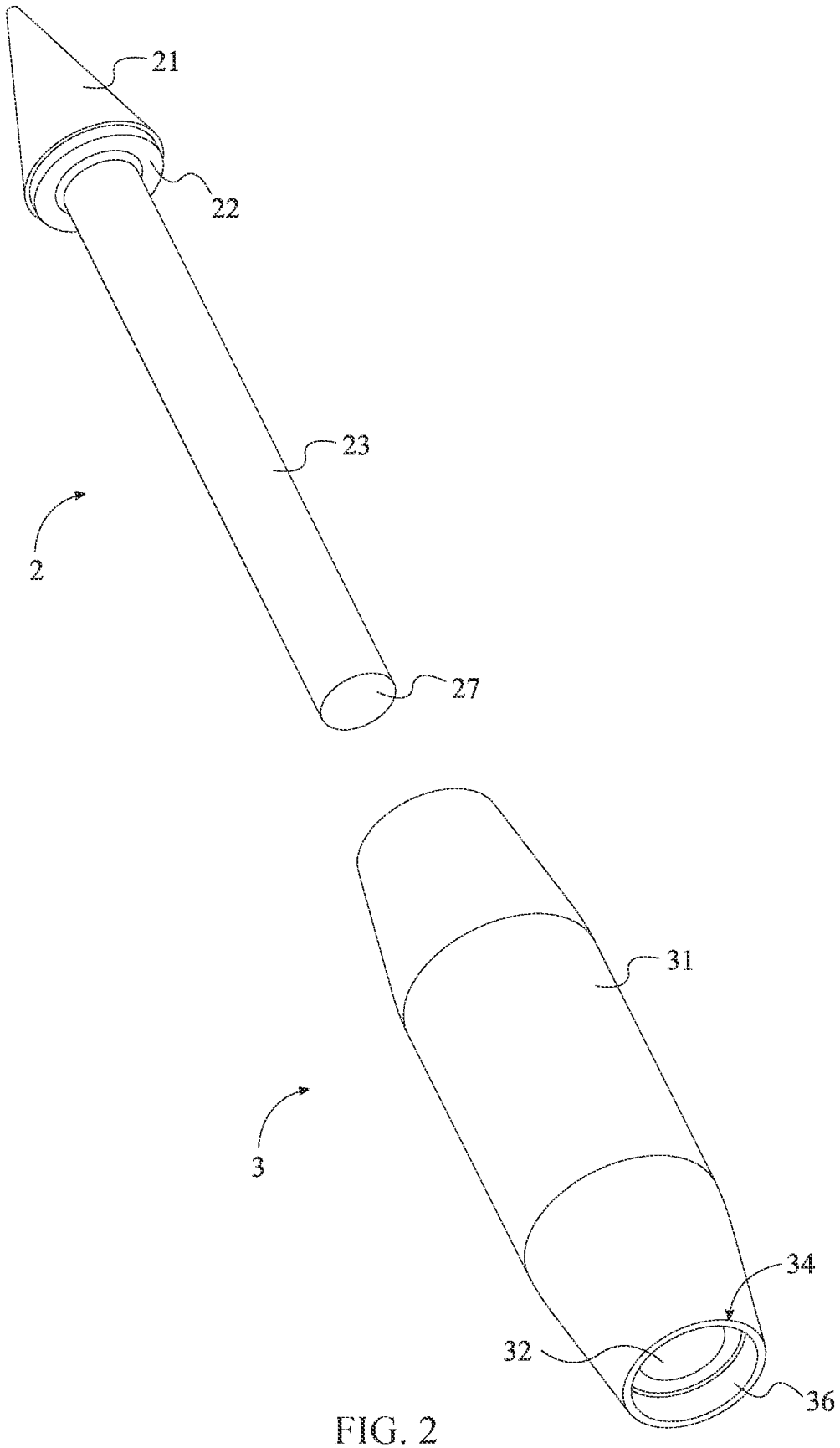
FIG. 2 is a bottom-front perspective exploded view of the present invention.
Figure 3:
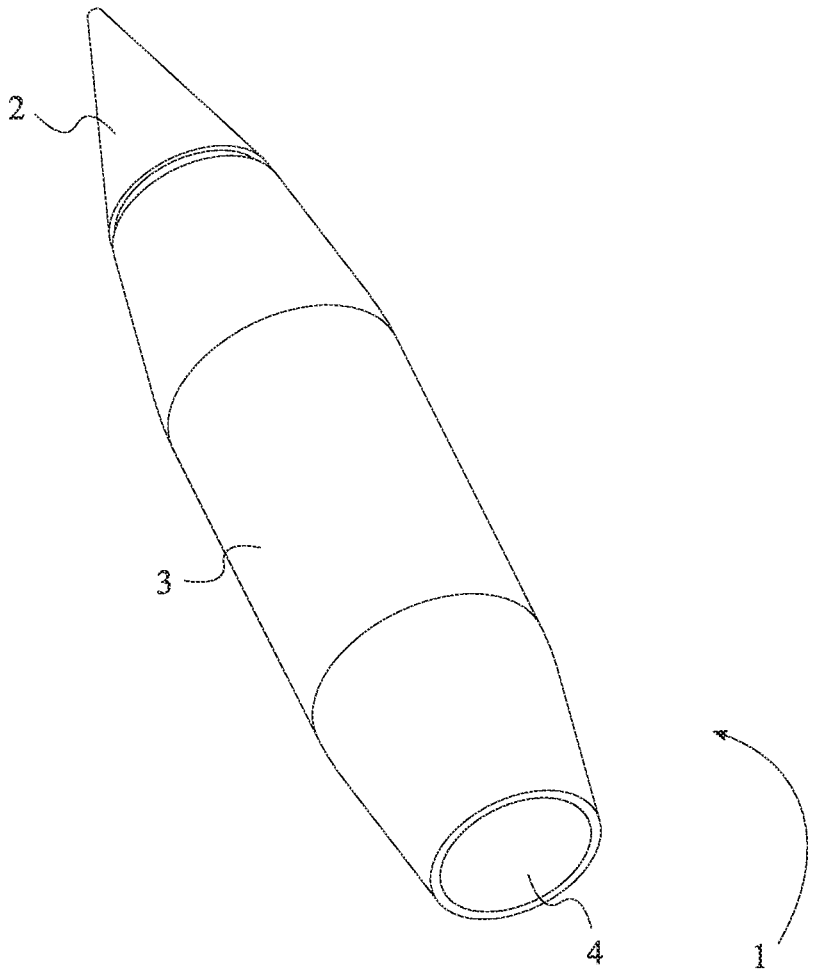
FIG. 3 is a bottom-front perspective view of the present invention.

As can be seen in FIG. 1 through FIG. 3, the alternate AP bullet 1 further comprises a penetrator 2, a jacket 3, and a metallic paste 4. The metallic paste 4 can be any type of repair paste that is designed to be effective in high-temperature environments. More specifically, the metallic paste 4 can be any temperature-resistant substance capable of forming a permanent bond between two adjoining metals or alloys, thereby connecting the two metals or alloys together after the metallic paste has cured.

Figure 7:
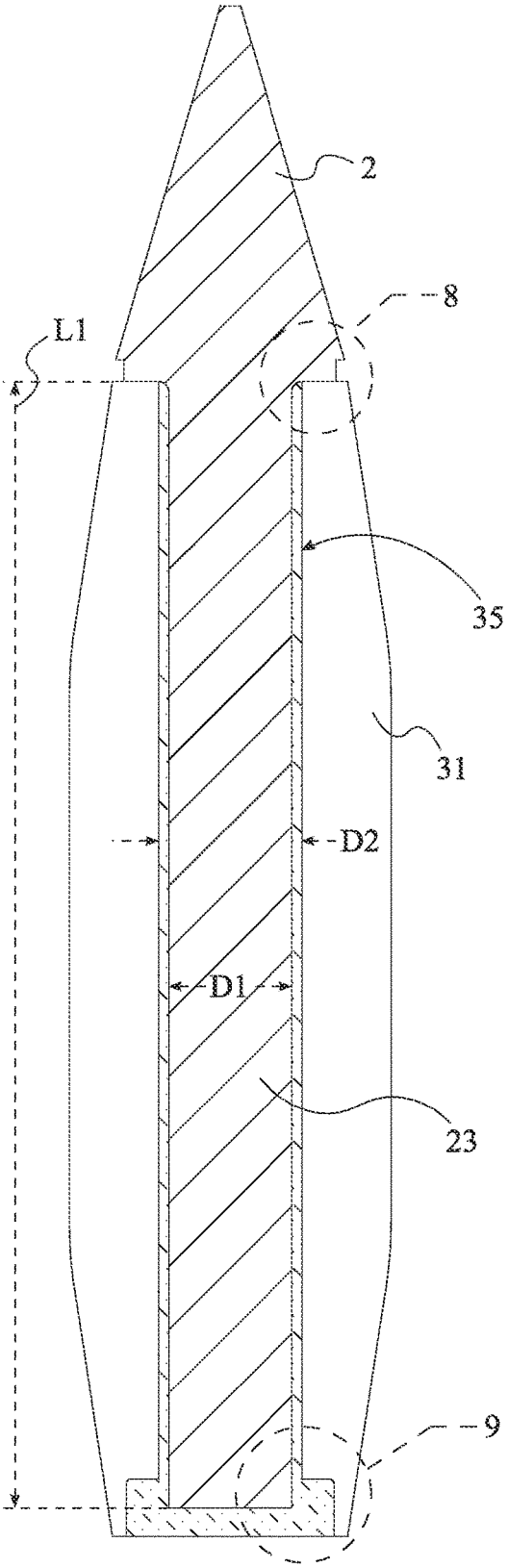
FIG. 7 is a front elevational cutaway view of the present invention, showing the arrangement of internal components.
Figure 8:
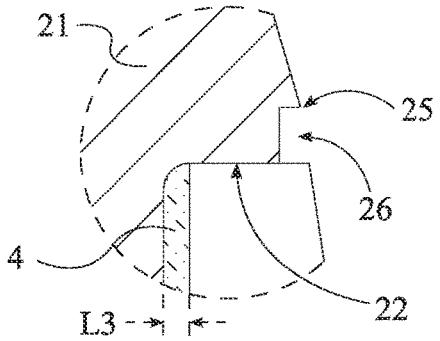
FIG. 8 is an enlarged view taken from FIG. 7, showing the upper portion detail.
Figure 9:
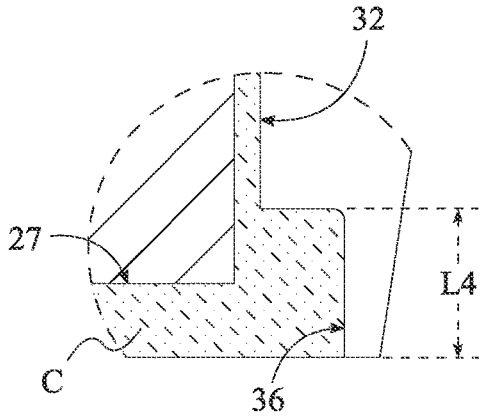
FIG. 9 is an enlarged view taken from FIG. 7, showing the lower portion detail.

The penetrator 2 functions as the primary structural component of the present invention, as the remaining components of the present invention are configured upon the penetrator 2. As best seen in FIG. 7 through FIG. 9, the penetrator 2 comprises an exterior tip 21, a tip base 22, and a cylindrical shaft 23. The shaft 23 extends axially away from the tip base 22 to a shaft end 27. The tip 21 extends axially away from the tip base 22, opposite to the shaft 23. Thus, the tip 21 and the shaft 23 are concentrically aligned, facing opposite of each other. Moreover, the tip 21 and the shaft 23 are terminally connected to the tip base 22, such that the penetrator 2 is formed from a single unitary piece. The shaft 23 has a predefined shaft diameter D1 and a predefined shaft length L1. The shaft length L1 extends from the tip base 22 to the shaft end 27. Preferably, the penetrator 2 is constructed from hardened steel. However, the material of the penetrator 2 is not limited to hardened steel and can be made of any other material based on design, user, and/or manufacturing requirements.

Figure 4:
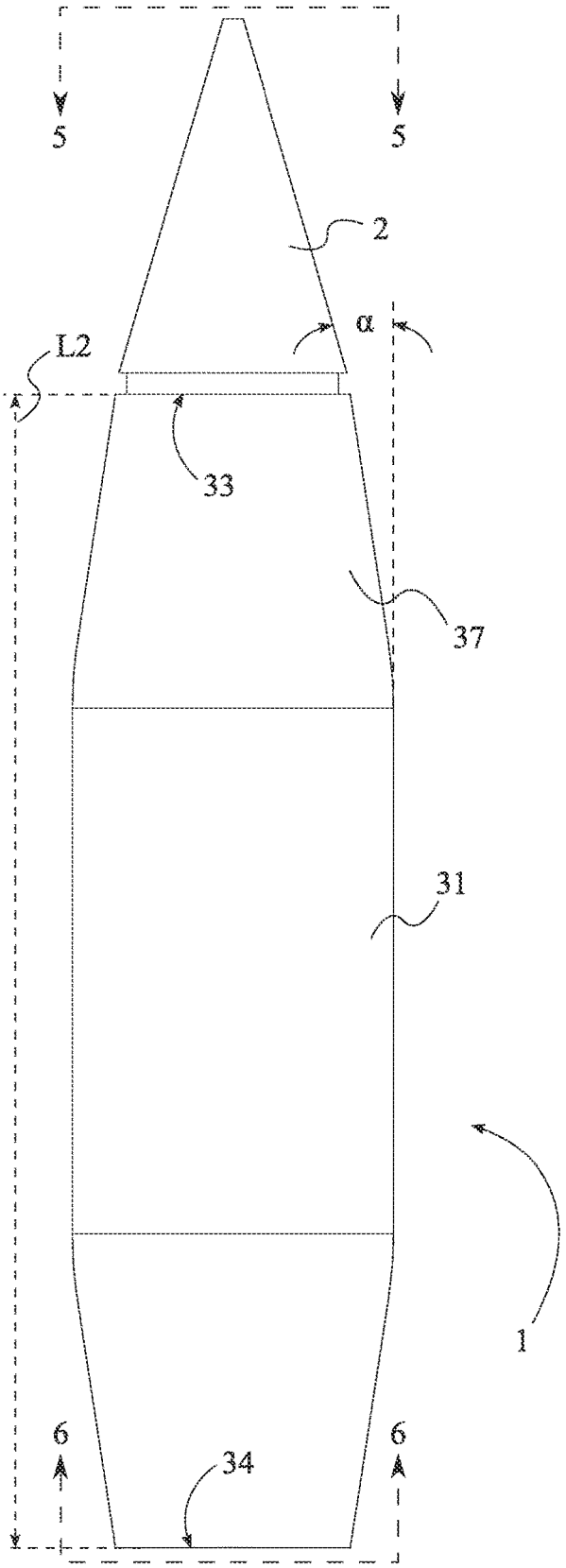
FIG. 4 is a front elevational view of the present invention.
Figure 5:
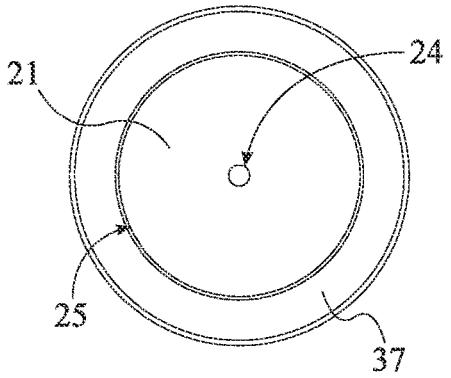
FIG. 5 is a sectional view taken along line 5-5 in FIG. 4.
Figure 6:
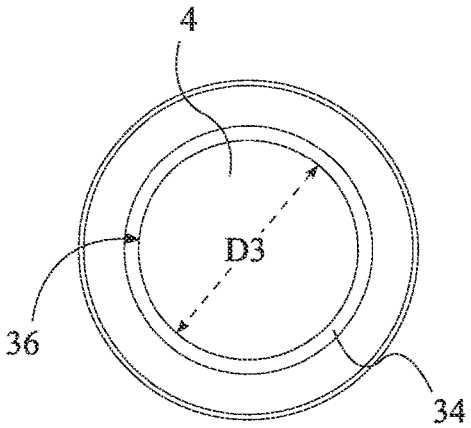
FIG. 6 is a sectional view taken along line 6-6 in FIG. 4.

As best seen in FIG. 4 through FIG. 6, the jacket 3 comprises a jacket body 31, a bore hole 35, and a bottom opening 36. The jacket body 31 is cylindrical in shape, extending longitudinally from a top surface 33 to a bottom surface 34. The bore hole 35 is axially disposed on the top surface 33, traversing longitudinally through the entire length of the jacket body 31, thereby forming an interior surface 32. The bore hole 35 has a predefined bore hole diameter D2. The bottom opening 36 is axially disposed on the bottom surface 34. Preferably, the jacket 3 is constructed from copper. However, the material of the jacket 3 is not limited to copper and can be made of any other material based on design, user, and/or manufacturing requirements.

To attach the penetrator 2 to the jacket 3, the bore hole diameter D2 is slightly larger than the shaft diameter D1, as seen in FIG. 7. This arrangement creates a gap L3 between the interior surface 32 of the jacket 3 and the shaft 23, as seen in FIG. 8. The shaft 23 is fully inserted into the bore hole 35, such that the tip base 22 of the penetrator 2 is seated on the top surface 33 of the jacket 3, and the shaft end 27 extends into the bottom opening 36, as seen in FIG. 9. The penetrator 2 is then bonded (i.e., fixedly attached) to the jacket 3 via the metallic paste 4. In particular, the shaft 23 of the penetrator 2 is coated with the metallic paste 4 prior to insertion. After insertion, the metallic paste 4 is subsequently disposed within the gap L3. The metallic paste 4 is also disposed within a remaining cavity C formed between the shaft 23 and the bottom opening 36, thereby sealing off the bottom surface 34 of the jacket 3. When the alternate AP bullet 1 is fired from a gun, the metallic paste 4 holds the jacket 3 and the penetrator 2 together until impacting the armor. Once the armor is pierced, the penetrator's long shaft length L1 assists in directional stability, allowing the penetrator 2 to maintain its trajectory and reach the intended target.

As best seen in FIG. 4 and FIG. 5, the tip 21 of the penetrator 2 has a conical shape that tapers outwardly from a point 24 to an annular leading lip 25, at a predefined tip angle $\alpha$. As best seen in FIG. 8, an annular recess 26 is disposed perimetrically about the annular leading lip 25. After which, the tip 21 traverses inward to intersect with the shaft 23, thereby forming the tip base 22 that surrounds the shaft 23.

As best seen in FIG. 4, the jacket body 31 has a substantially constant diameter, which is configured to engage the interior surface of a barrel of a gun of a specific caliber. In a preferred embodiment, the top surface 33 is tapered to match the conical shape of the tip 21 of the penetrator 2. More specifically, the tip angle $\alpha$ of the penetrator 2 matches an angle of a tapered portion 37 at the top surface 33 of the jacket 3, such that the shape of the tip 21 is extended onto the top surface 33 of the jacket 3. This arrangement provides a smooth aerodynamic shape in the tip-to-jacket transition. Preferably, the bottom surface 34 of the jacket 3 is tapered as well, as is commonly formed in the projectile industry, otherwise known as a boat tail.

To seal off the bottom surface 34 of the jacket 3, the bottom opening 36 traverses longitudinally in the direction of the top surface 33 at a predefined bottom opening length L4, as seen in FIG. 9. The bottom opening 36 has a predefined bottom opening diameter D3 that is larger than the bore hole diameter D2, thereby delineating the cavity C formed between the shaft 23 and the bottom opening 36. In this arrangement, the bottom opening 36 increases the amount of available space occupied by the metallic paste 4, which in turn, increases the adhesion force that secures the penetrator 2 to the jacket 3.

In a preferred embodiment, the jacket 3 has a jacket length L2 that is slightly longer than the shaft length L1 of the penetrator 2, as seen in FIG. 7. This allows the user to coat all surrounding surfaces of the shaft 23 with the metallic paste 4, including the shaft end 27, thereby increasing the adhesion force between the penetrator 2 and the jacket 3. In another embodiment, the jacket length L2 is equal to the shaft length L1, such that the shaft end 27 is flush with the bottom surface 34 of the jacket 3.

Figure 10:
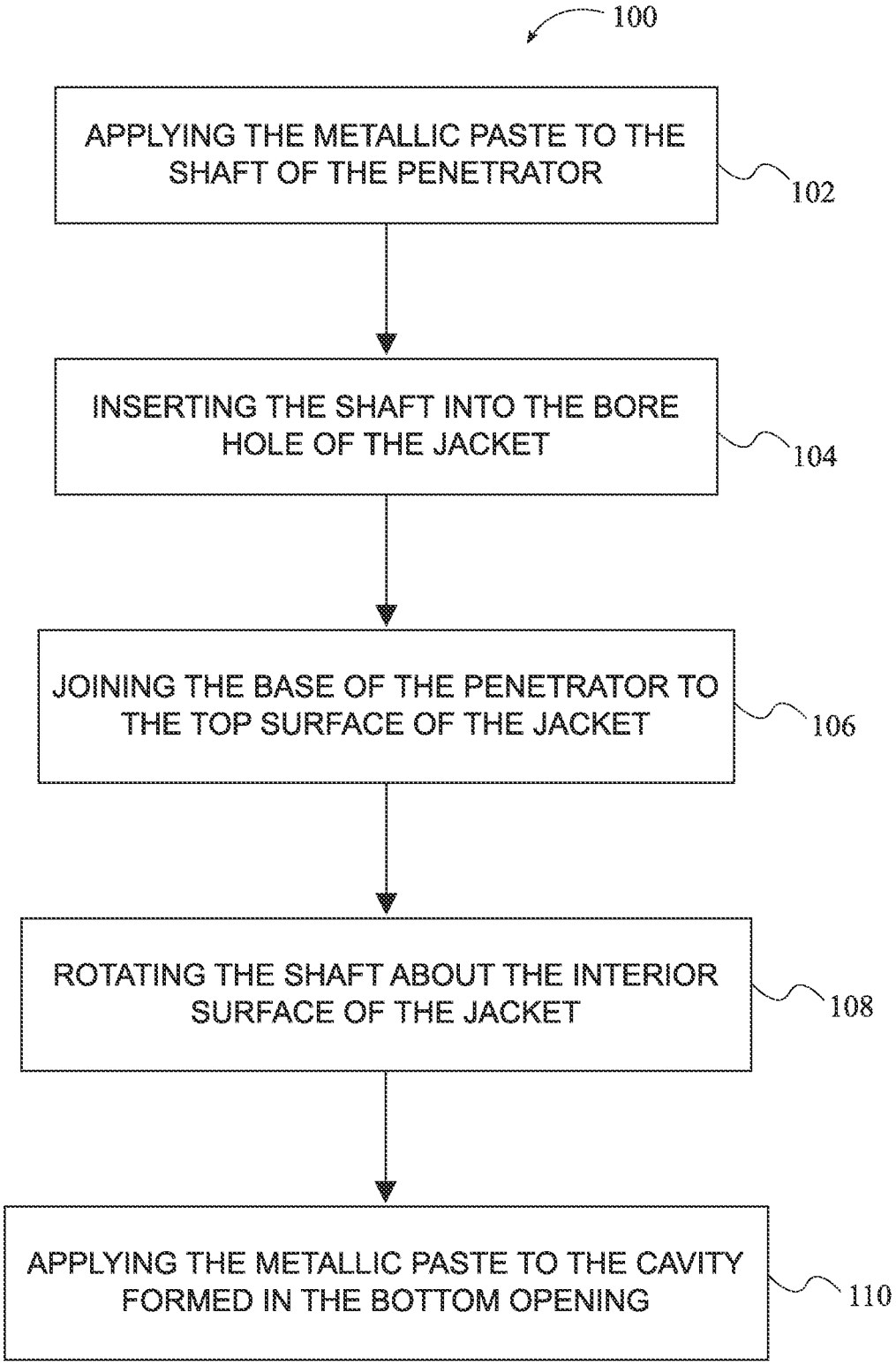
FIG. 10 is a flowchart of a method for producing an alternate armor-piercing bullet.

FIG. 10 illustrates the steps of a method 100 for producing the alternate AP bullet 1 described above. At 102, the method 100 may include applying the metallic paste to the shaft of the penetrator, thereby coating all surfaces of the shaft. Further, at 104, the method 100 may include inserting the shaft into the bore hole of the jacket from the top surface. Further, at 106, the method 100 may include joining the tip base of the penetrator to the top surface of the jacket. Further, at 108, the method 100 may include rotating the shaft about the interior surface of the jacket, thereby distributing the metallic paste evenly within the gap formed between the interior surface and the shaft. Further, at 110, the method 100 may include applying the metallic paste to the remaining cavity formed in the bottom opening.

Although the invention has been explained in relation to its preferred embodiment, it is to be understood that many other possible modifications and variations can be made without departing from the spirit and scope of the invention.

What is claimed is:

1. A firearm projectile comprising:

a penetrator;

a jacket;

a metallic paste;

the penetrator comprising a tip, a tip base, and a shaft;
the shaft extending axially away from the tip base to a shaft end;
the tip extending axially away from the tip base, opposite to the shaft;
the jacket comprising a jacket body, a bore hole, and a bottom opening;
the bore hole being axially disposed on a top surface of the jacket;
the bore hole traversing through the jacket body;
the bore hole forming an interior surface of the jacket;
the bore hole having a bore hole diameter larger than a shaft diameter;
the bottom opening being axially disposed on a bottom surface of the jacket;
the bottom opening traversing into the jacket body;
a bottom opening diameter being larger than the bore hole diameter;
the shaft being inserted into the bore hole;
the tip base of the penetrator being seated on the top surface of the jacket;
the tip comprising a point, an annular leading lip, and an annular recess;
the tip tapering outward from the point to the annular leading lip;
the tip traversing inward from the annular recess to intersect the shaft;
the tip base being formed between the annular recess and the shaft;
the shaft end extending into the bottom opening;
the metallic paste being disposed in a gap formed between the interior surface and the shaft;
the metallic paste being disposed in a cavity formed between the shaft and the bottom opening; and
the metallic paste fixedly attaching the penetrator to the jacket.

2. The firearm projectile as claimed in claim 1 comprising:
the tip having a predefined tip angle;
the jacket comprising a tapered portion;
the tapered portion being adjacent to the top surface; and
the tip angle matching an angle of the tapered portion.

3. The firearm projectile as claimed in claim 1 comprising:
the jacket having a jacket length; and
the shaft having a shaft length.

4. The firearm projectile as claimed in claim 3, wherein the jacket length being longer than the shaft length.

5. The firearm projectile as claimed in claim 3, wherein the jacket length being equal to the shaft length.

6. A firearm projectile comprising:
a penetrator;
a jacket;
a metallic paste;
the penetrator comprising a tip, a tip base, and a shaft;
the shaft extending axially away from the tip base to a shaft end;
the tip extending axially away from the tip base, opposite to the shaft;
the jacket comprising a jacket body, a bore hole, a bottom opening, and a tapered portion;
the bore hole being axially disposed on a top surface of the jacket;
the bore hole traversing through the jacket body;
the bore hole forming an interior surface of the jacket;
the bore hole having a bore hole diameter larger than a shaft diameter;
the bottom opening being axially disposed on a bottom surface of the jacket;
the bottom opening traversing into the jacket body;
a bottom opening diameter being larger than the bore hole diameter;
the shaft being inserted into the bore hole;
the tip base of the penetrator being seated on the top surface of the jacket;
the tip comprising a point, an annular leading lip, and a predefined tip angle;
the tip tapering outward from the point to the annular leading lip;
the tapered portion being adjacent to the top surface of the jacket;
the tip angle matching an angle of the tapered portion;
the shaft end extending into the bottom opening;
the shaft end being flush with the bottom surface of the jacket;
the metallic paste being disposed in a gap formed between the interior surface and the shaft;
the metallic paste being disposed in a cavity formed between the shaft and the bottom opening; and
the metallic paste fixedly attaching the penetrator to the jacket.

7. The firearm projectile as claimed in claim 5 comprising:
the tip further comprising an annular recess;
the annular recess being disposed perimetrically about the annular leading lip;
the tip traversing inward from the annular recess to intersect the shaft; and
the tip base being formed between the annular recess and the shaft.

8. A method for producing a firearm projectile, the method comprising:
providing a penetrator, a jacket, and a metallic paste;
the penetrator further comprising a tip, a tip base, and a shaft;
the shaft extending axially away from the tip base to a shaft end;
the tip extending axially away from the tip base, opposite to the shaft;
the jacket comprising a jacket body, a bore hole, and a bottom opening;
the bore hole being axially disposed on a top surface of the jacket;
the bore hole traversing through the jacket body;
the bore hole forming an interior surface of the jacket;
the bore hole having a bore hole diameter larger than a shaft diameter;
the bottom opening being axially disposed on a bottom surface of the jacket;
the bottom opening traversing into the jacket body;
a bottom opening diameter being larger than the bore hole diameter;
the tip comprising a point, an annular leading lip, and an annular recess;
the tip tapering outward from the point to the annular leading lip;
the tip traversing inward from the annular recess to intersect the shaft;
the tip base being formed between the annular recess and the shaft;
applying the metallic paste to the shaft of the penetrator;
inserting the shaft into the bore hole of the jacket;
joining the tip base of the penetrator to the top surface of the jacket;

rotating the shaft about the interior surface of the jacket; and applying the metallic paste to a cavity formed in the bottom opening.

9. The method as claimed in claim 8 comprising:

the tip having a predefined tip angle;

the jacket comprising a tapered portion;

the tapered portion being adjacent to the top surface; and the tip angle matching an angle of the tapered portion.

10. The method as claimed in claim 8 comprising:

the jacket having a jacket length;

the shaft having a shaft length; and the jacket length being longer than the shaft length.

* * * * *